US008475123B2

(12) United States Patent
Ai et al.

(10) Patent No.: US 8,475,123 B2
(45) Date of Patent: Jul. 2, 2013

(54) FAN HOUSING STRUCTURE

(75) Inventors: Qi Ai, Sinjhuang (TW); Zhao-Yun Huang, Sinjhuang (TW)

(73) Assignee: Beijing AVC Technology Research Center Co., Ltd., Beijing (CN)

( * ) Notice: Subject to any disclaimer, the term of this patent is extended or adjusted under 35 U.S.C. 154(b) by 723 days.

(21) Appl. No.: 12/700,733

(22) Filed: Feb. 5, 2010

(65) Prior Publication Data

US 2011/0194930 A1 Aug. 11, 2011

(51) Int. Cl.
*F01D 1/00* (2006.01)

(52) U.S. Cl.
USPC ..... 415/200; 415/204; 415/206; 415/217.1

(58) Field of Classification Search
USPC ..... 415/200, 201, 203, 204, 206, 213.1, 415/215.1, 217.1
See application file for complete search history.

(56) References Cited

U.S. PATENT DOCUMENTS 3,961,864 A * 6/1976 Papst et al. ..... 415/217.1
4,164,690 A * 8/1979 Muller et al. ..... 318/400.41
4,885,488 A * 12/1989 Cox ..... 310/68 R
6,000,919 A * 12/1999 Hsieh ..... 415/220
6,274,955 B1 * 8/2001 Satoh et al. ..... 310/71
6,394,768 B1 * 5/2002 Fukuda et al. ..... 417/423.15
6,720,690 B2 * 4/2004 Hirai et al. ..... 310/81

FOREIGN PATENT DOCUMENTS

TW M256513 U 2/2005
TW I353509 B1 12/2011

* cited by examiner

*Primary Examiner* — Igor Kershteyn

(57) ABSTRACT

A fan housing structure including a base seat and a sideboard. The base seat has a bed section and a mating section extending along a periphery of the bed section. The bed section has a bush made of a material other than the material of the bed section. The bush is disposed on the bed section to axially protrude therefrom. The sideboard is made of a material other than the material of the base seat. The sideboard is disposed on the mating section and integrally connected with the base seat. The sideboard and the base seat together define a space therebetween. The sideboard and the bush are made of a material other than the material of the base seat and are integrally connected with the base seat by means of insert injection molding. Accordingly, the fan housing structure has enhanced structural strength and thinner thickness to save room.

9 Claims, 4 Drawing Sheets

FAN HOUSING STRUCTURE

FIELD OF THE INVENTION

The present invention relates generally to a fan housing, and more particularly to a fan housing structure including a base seat and a sideboard. The base seat has a bed section having a bush. The bush is made of a material other than the material of the bed section. The sideboard is made of a material other than the material of the base seat. The sideboard and the bush are integrally connected with the base seat by means of insert injection molding. Accordingly, the fan housing structure has enhanced structural strength and thinner thickness to save room.

BACKGROUND OF THE INVENTION

Following the rapid advance of electronic and information technologies, all kinds of electronic products (such as desktop computers and notebook computers) have been more and more popularly used and widely applied to various fields. There is a trend to miniaturize the sizes and thin the thickness of the electronic products. As exemplified with a notebook computer, the thickness of the notebook computer is thinner and thinner. Consequently, due to limitation of the space, the heat generated by the electronic components inside the notebook computer, such as the central processing unit (CPU), can be hardly efficiently dissipated. In this case, the heat will accumulate to cause a rise of temperature.

In order to avoid temporary or permanent failure of the notebook computer due to overheating of the CPU, conventionally, a thin-type fan is directly disposed on the CPU to forcedly quickly dissipate the heat generated by the CPU to external environment so as to keep the CPU normally working at high speed.

Please refer to FIGS. 1A and 1B, in which FIG. 1A is a perspective exploded view of a conventional fan housing structure, while FIG. 1B is perspective assembled view of the conventional fan housing structure. The fan housing structure is made of plastic material, including a base seat 10 and an upper cover 13. The base seat 10 has a bush 101 and multiple perforations (not shown) around the bush 101. The bush 101 is formed at a center of the base seat 10 for mating with a corresponding fan propeller 14. The base seat 10 has a sidewall 12 perpendicularly extending from a periphery of the base seat 10. The sidewall 12 and the base seat 10 together define a space 15 in communication with the perforations. Two opposite ends of the sidewall 12 define therebetween a wind exit 151 in communication with the space 15. The upper cover 13 has an opening 131 in communication with the space 15. The upper cover 13 is fitted on the base seat 10 to form the fan housing structure.

The conventional base seat 10, bush 101 and sidewall 12 are made by means of integral injection molding. The bush 101 integrally protrudes from the base seat 10. As a result, the axial thickness of the base seat 10 is increased. This leads to insufficient room of the fan housing structure. Moreover, in the injection molding process of the conventional fan housing structure, the base seat 10 must have sufficient thickness. For example, in the case that the base seat 10 simply has a thickness of 0.5 mm, the base seat 10 is apt to deform and damage. Under such circumstance, the fan housing structure will apparently have poor structural strength, especially in the base seat 10. According to the above, the conventional fan housing structure has the following defects:

1. The conventional fan housing structure is apt to deform.
2. The conventional fan housing structure has insufficient room.
3. The conventional fan housing structure has poor strength.

SUMMARY OF THE INVENTION

A primary object of the present invention is to provide a fan housing structure including a base seat and a sideboard. The base seat has a bed section having a bush. The bush is made of a material other than the material of the bed section. The sideboard is made of a material other than the material of the base seat. The sideboard and the bush are integrally connected with the base seat by means of insert injection molding. Accordingly, the fan housing structure has thinner thickness to save room.

A further object of the present invention is to provide the above fan housing structure, which has enhanced structural strength.

To achieve the above and other objects, the fan housing structure of the present invention includes: a base seat having a bed section and a mating section, the bed section having a bush made of a material other than the material of the bed section, the bush being disposed on the bed section to axially protrude therefrom, the mating section extending along a periphery of the bed section; and a sideboard made of a material other than the material of the base seat, the sideboard being disposed on the mating section and integrally connected with the base seat, the sideboard and the base seat together defining a space therebetween. The base seat and the bed section are made of a material other than the material of the sideboard and the bush. In addition, the bush and the sideboard are integrally connected with the base seat by means of insert injection molding. Accordingly, the fan housing has enhanced structural strength and is thinned to save room.

BRIEF DESCRIPTION OF THE DRAWINGS

The structure and the technical means adopted by the present invention to achieve the above and other objects can be best understood by referring to the following detailed description of the preferred embodiments and the accompanying drawings, wherein.

DETAILED DESCRIPTION OF THE PREFERRED EMBODIMENTS

Figure 1A:
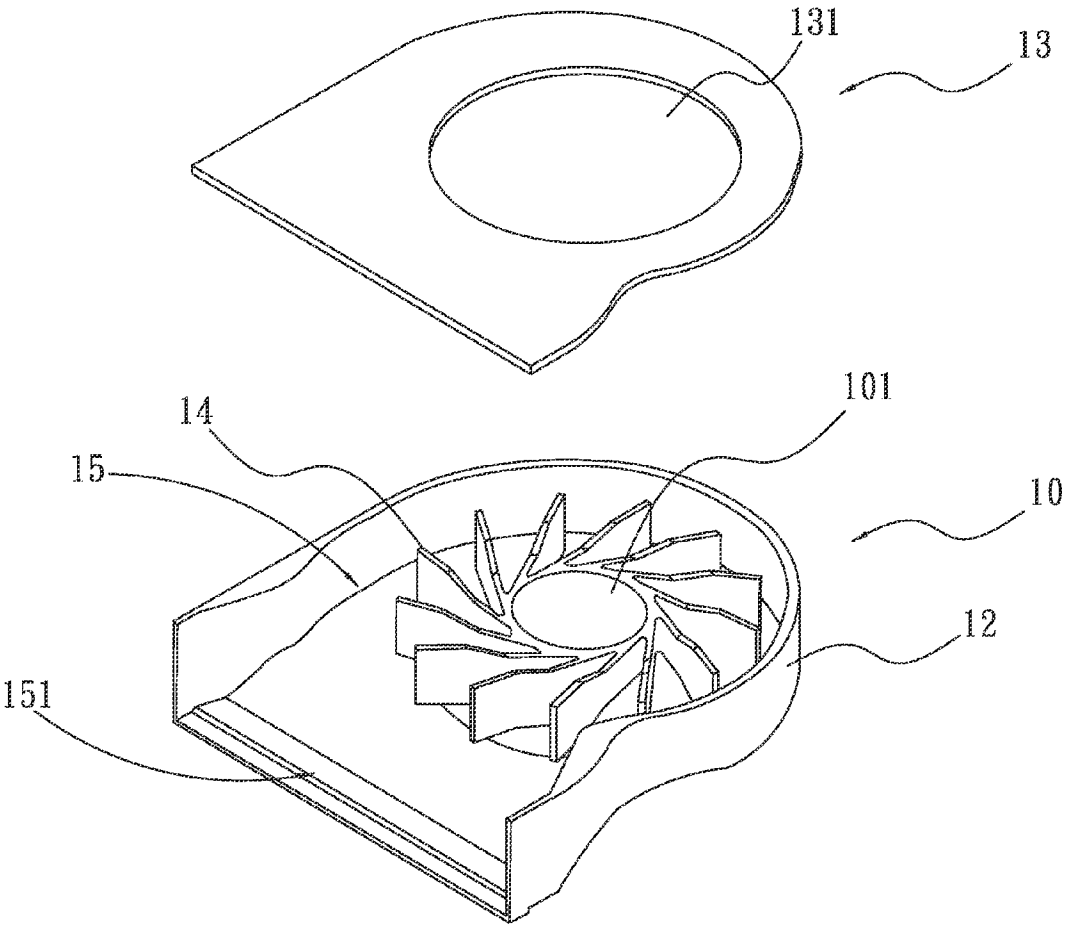
Fig. 1A(PRIOR ART)
FIG. 1A is a perspective exploded view of a conventional fan housing structure.
Figure 1B:
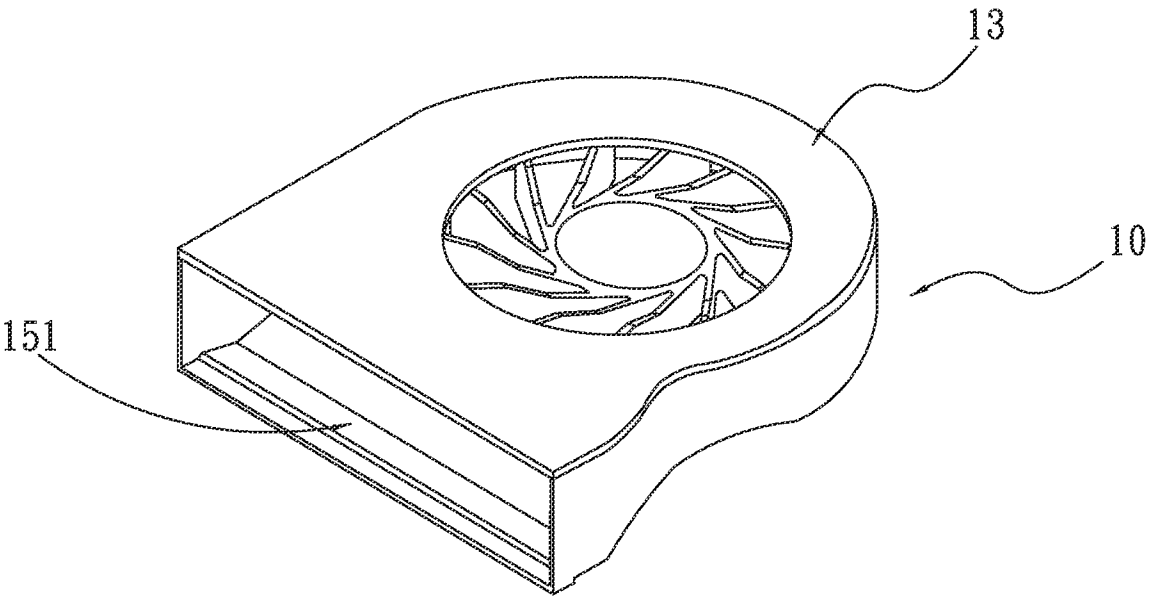
Fig. 1B(PRIOR ART)
FIG. 1B is perspective assembled view of the conventional fan housing structure.
Figure 2:
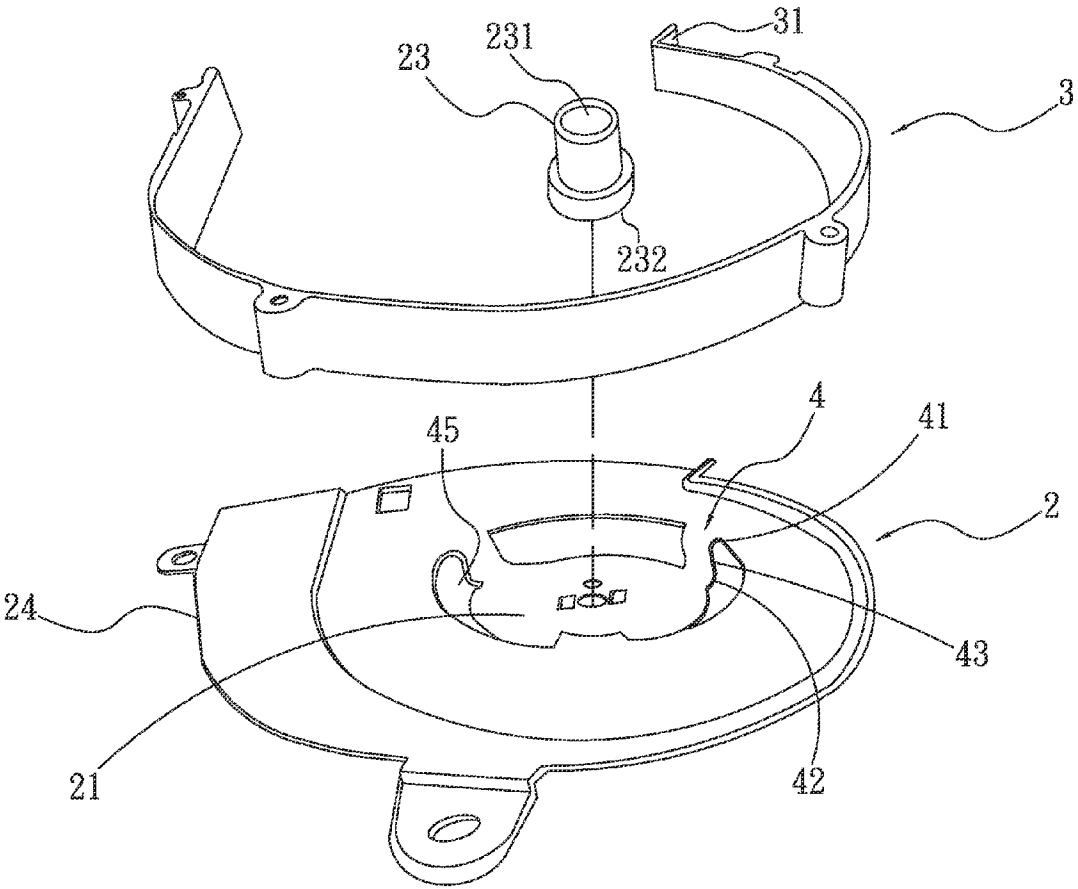
FIG. 2 is a perspective exploded view of a preferred embodiment of the fan housing structure of the present invention.
Figure 3:
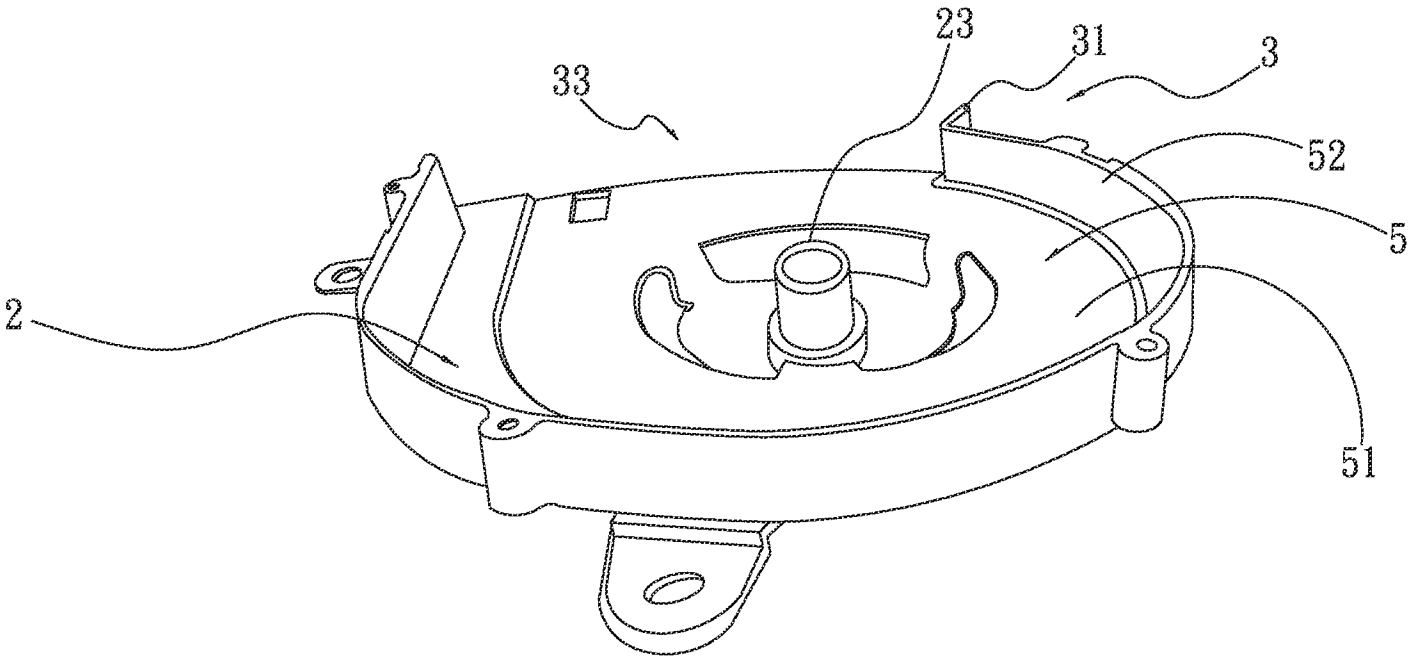
FIG. 3 is perspective assembled view of the preferred embodiment of the fan housing structure of the present invention.

Please refer to FIGS. 2 and 3. According to a preferred embodiment, the fan housing structure of the present invention includes a base seat 2 and a sideboard 3. The base seat 2 has a bed section 21 and a mating section 24 extending along a periphery of the bed section 21. The bed section 21 has a bush 23 made of a material other than the material of the bed section 21. The bush 23 is disposed on the bed section 21 to axially protrude therefrom. The bush 23 can be integrally connected with the bed section 21 by means of insert injection molding. The bush 23 has an open end 231 and a closed end 232. The closed end 232 is mated with the bed section 21. A fan propeller (not shown) is pivotally connected with the bush 23.

The sideboard 3 is made of a material other than the material of the base seat 2. The sideboard 3 is disposed on the mating section 24 by means of insert injection molding to integrally connect with the base seat 2. The sideboard 3 and the base seat 2 together define a space 5 therebetween. The sideboard 3 has at least one extension section 31, which extends from one of two opposite ends of the sideboard 3 in a direction away therefrom to define a wind exit 33 in communication with the space 5. The fan propeller serves to blow air, which is guided to the wind exit 33 and collectively exhausted from the wind exit 33.

The bush 23 is made of a material other than the material of the bed section 21. The sideboard 3 is made of a material other than the material of the base seat 2. In this embodiment, the bush 23 and the sideboard 3 are made of, but not limited to, plastic material, while the bed section 21 and the base seat 2 are made of, but not limited to, metal material such as stainless steel, aluminum and iron.

The base seat 2 and the bed section 21 of the present invention are made of metal material so that they can have a thickness thinner than that of a plastic-made base seat. For example, the base seat 2 and the bed section 21 can have a thickness of 0.3 mm, while still having a sufficient strength (or hardness) without tending to deform. In contrast, a plastic-made base seat with a thickness of 0.5 mm has poor strength and is apt to deform.

Please refer to FIGS. 2 and 3. The space 5 has a closed side 51 and an open side 52 opposite to the closed side 51. The base seat 2 serves as the closed side 51. The open side 52 is defined within the sideboard 3 and distal from the base seat 2. A cover body (not shown) is mated with the sideboard 3 to block the open side 52.

The bed section 21 is connected to the base seat 2 via multiple support bodies 4. Each support body 4 has a first bending section 41, a second bending section 42 and an interconnection section 43. The first bending section 41 is connected with the base seat 2, the second bending section 42 is connected with the bed section 21, while the interconnection section 43 is interconnected between the first and second bending sections 41, 42. Accordingly, a height difference exists between the base seat 2 and the bed section 21. Each two adjacent support bodies 4 define therebetween an opening 45 in communication with the space 5.

According to the above arrangement, the base seat 2 and the bed section 21 are made of a material other than the material of the sideboard 3 and the bush 23. In addition, the bush 23 and the sideboard 3 are integrally connected with the base seat 2 by means of insert injection molding. Accordingly, on one hand, the fan housing can be thinned as a whole to save internal room of the electronic product. On the other hand, the problem of insufficient room inside the fan housing can be overcome. Also, the structural strength of the fan housing can be enhanced.

In conclusion, the fan housing structure of the present invention has the following advantages:

1. The fan housing structure of the present invention occupies less room.
2. The fan housing structure of the present invention has better strength.
3. The fan housing structure of the present invention is not apt to deform.

The present invention has been described with some preferred embodiments thereof and it is understood that many changes and modifications in the described embodiments can be carried out without departing from the scope and the spirit of the invention that is intended to be limited only by the appended claims.

What is claimed is:

1. A fan housing structure comprising:

a base seat having a bed section and a mating section, the bed section having a bush made of a material other than the material of the bed section, the bush being disposed on the bed section to axially protrude therefrom, the mating section extending along a periphery of the bed section;

a sideboard made of a material other than the material of the base seat, the sideboard being disposed on the mating section and integrally connected with the base seat, the sideboard and the base seat together defining a space therebetween, wherein the bed section is connected to the base seat via multiple support bodies; and wherein each support body has a first bending section, a second bending section and an interconnection section, the first bending section being connected with the base seat, the second bending section being connected with the bed section, and the interconnection section being interconnected between the first and second bending sections.

2. The fan housing structure as claimed in claim 1, wherein the sideboard has at least one extension section, which defines a wind exit.

3. The fan housing structure as claimed in claim 1, wherein each two adjacent support bodies define therebetween an opening in communication with the space.

4. The fan housing structure as claimed in claim 1, wherein a fan propeller is pivotally connected with the bush.

5. The fan housing structure as claimed in claim 1, wherein the bush has an open end and a closed end, the closed end being mated with the bed section.

6. The fan housing structure as claimed in claim 1, wherein the space has a closed side and an open side, the base seat serving as the closed side, the open side being defined within the sideboard and distal from the base seat.

7. The fan housing structure as claimed in claim 1, wherein the sideboard is disposed on the mating section by means of insert injection molding.

8. The fan housing structure as claimed in claim 1, wherein the base seat is made of metal material.

9. The fan housing structure as claimed in claim 1, wherein the sideboard and the bush are made of plastic material.

* * * * *